US006604502B1

(12) United States Patent
Bisaro et al.

(10) Patent No.: US 6,604,502 B1
(45) Date of Patent: Aug. 12, 2003

(54) METHOD FOR CONTROLLING AN INTERNAL COMBUSTION ENGINE DURING ENGINE SHUTDOWN TO REDUCE EVAPORATIVE EMISSIONS

(75) Inventors: Darren Bisaro, Dearborn, MI (US); David Lee Boggs, Bloomfield Hills, MI (US); Mark William Peters, Wolverine Lake, MI (US); Stephen Richard Burke, Dearborn, MI (US); Stephen John Kotre, Ann Arbor, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 554 days.

(21) Appl. No.: 09/671,713

(22) Filed: Sep. 27, 2000

(51) Int. Cl.[7] ..... F02B 77/00

(52) U.S. Cl. ..... 123/198 DB; 123/679; 123/497

(58) Field of Search ..... 123/495, 497, 123/467, 198 DB, 478, 672, 679

(56) References Cited

U.S. PATENT DOCUMENTS 4,574,752 A * 3/1986 Reichert, Jr. et al. . 123/198 DB
5,074,272 A * 12/1991 Bostick et al. ..... 123/198 DB
5,159,911 A * 11/1992 Williams et al. ..... 123/467
5,253,632 A 10/1993 Brooks ..... 123/696
5,878,710 A * 3/1999 Ritter et al. ..... 123/198 DB

* cited by examiner

*Primary Examiner*—Thomas N. Moulis
(74) *Attorney, Agent, or Firm*—John F. Buckert; Allan J. Lippa

(57) ABSTRACT

A method of controlling an engine 12 during engine shutdown to reduce evaporative emissions is provided. The method includes a step 50 of shutting off a fuel pump 28 of the engine 12. The method also includes a step 52 of burning off the fuel from a fuel rail 24 in a cylinder 18 of the engine 12 after the fuel pump 28 is shut off. During the burning off of the fuel, a duty cycle of each fuel injector 22of engine 12 is controlled to allow the engine 12 to operate generally cyclically about a predetermined air/fuel ratio. The predetermined air/fuel ratio is preferably stoichiometric. By burning off the fuel in the fuel rail 24 after the fuel pump 28 is shut off, the fuel pressure in the fuel rail 24 is reduced. The reduced fuel pressure in the fuel rail 24results in reduced evaporative emissions from the engine 12.

27 Claims, 4 Drawing Sheets

METHOD FOR CONTROLLING AN INTERNAL COMBUSTION ENGINE DURING ENGINE SHUTDOWN TO REDUCE EVAPORATIVE EMISSIONS

FIELD OF THE INVENTION

This invention relates to a method for controlling an internal combustion engine during engine shutdown to reduce evaporative emissions. In particular, the invention relates to a method for reducing fuel pressure in a fuel rail of the engine, during engine shutdown, to reduce evaporative emissions.

BACKGROUND OF THE INVENTION

Internal combustion engines are generally controlled to maintain the ratio of air and fuel at or near stoichiometry. In particular, the engines are controlled utilizing closed-loop control where the amount of fuel delivered to the engine is determined primarily by the concentration of oxygen in the exhaust gases. The amount of oxygen in the exhaust gas is indicative of the ratio of air and fuel that has been ignited in the engine.

Known engines sense the oxygen level in the exhaust gases of the engine utilizing a Heated Exhaust Gas Oxygen (HEGO) sensor. Further, known engine control systems adjust the commanded air/fuel ratio of the engine responsive to the output of the HEGO sensor.

Known engines also utilize a three-way catalytic converter to reduce the unwanted by-products of combustion. The ratio of air and fuel may be maintained near stoichiometry for efficient operation of the catalytic converter.

Known engine control systems stop the closed-loop control of an engine when an ignition switch changes to a state that indicates that the engine should be shut down. In particular, the control systems immediately shut off a fuel pump and stop transmitting control signals to fuel injectors of the engine. As a result, the fuel injectors immediately stop supplying fuel to the engine cylinders. Further, known engine fueling systems utilize a check valve to maintain the fuel in a fuel rail at a relatively high pressure after engine shutdown. For purposes of discussion, the term "fuel rail" means one or more fuel lines supplying fuel to one or more fuel injectors. It has been determined that leaving the fuel in the fuel rail at the relatively high pressure, after engine shutdown, results in increased evaporative emissions.

SUMMARY OF THE INVENTION

The present invention provides an automotive vehicle and a method of controlling an internal combustion engine during engine shutdown to reduce evaporative emissions.

An automotive vehicle in accordance with the present invention includes an engine having fuel injectors selectively supplying fuel to cylinders of the engine. The vehicle further includes a fuel pump selectively supplying fuel through a fuel rail to the fuel injectors. The vehicle further includes a controller operatively connected to the fuel injectors and the fuel pump. The controller is configured to shut off the fuel pump upon a change of state of an engine control signal. Finally, the controller is configured to control a duty cycle of the fuel injectors, after said fuel pump is shut off, to allow the engine to operate cyclically about a predetermined air/fuel ratio. Controlling the engine after the fuel pump has been shut off results in the residual fuel in the fuel rail being ignited in the engine cylinders. Thus, the fuel pressure in the fuel rail will be decreased during an engine shutdown time interval resulting in decreased evaporative emissions.

A method of controlling an internal combustion engine during engine shutdown in accordance with the present invention includes a step of shutting off a fuel pump of the engine. The method further includes a step of burning off the fuel from the fuel rail in an engine cylinder after the fuel pump is shut off. During the burning off of the fuel, a duty cycle of a fuel injector is controlled to allow the engine to operate generally cyclically about a predetermined air/fuel ratio. The predetermined air/fuel ratio is preferably stoichiometric.

An automotive vehicle and a method for controlling an internal combustion engine in accordance with the present invention represent a significant improvement over conventional vehicles and methods. In particular, the inventive automotive vehicle and method decreases the fuel pressure in the fuel rail, during an engine shutdown time interval before completely shutting down the engine. As a result, evaporative emissions from the fuel injectors is decreased when the vehicle is not being operated.

These and other features and advantages of this invention will become apparent to one skilled in the art from the following detailed description and the accompanying drawings illustrating features of this invention by way of example.

DETAILED DESCRIPTION OF THE PREFERRED EMBODIMENT

Figure 1:
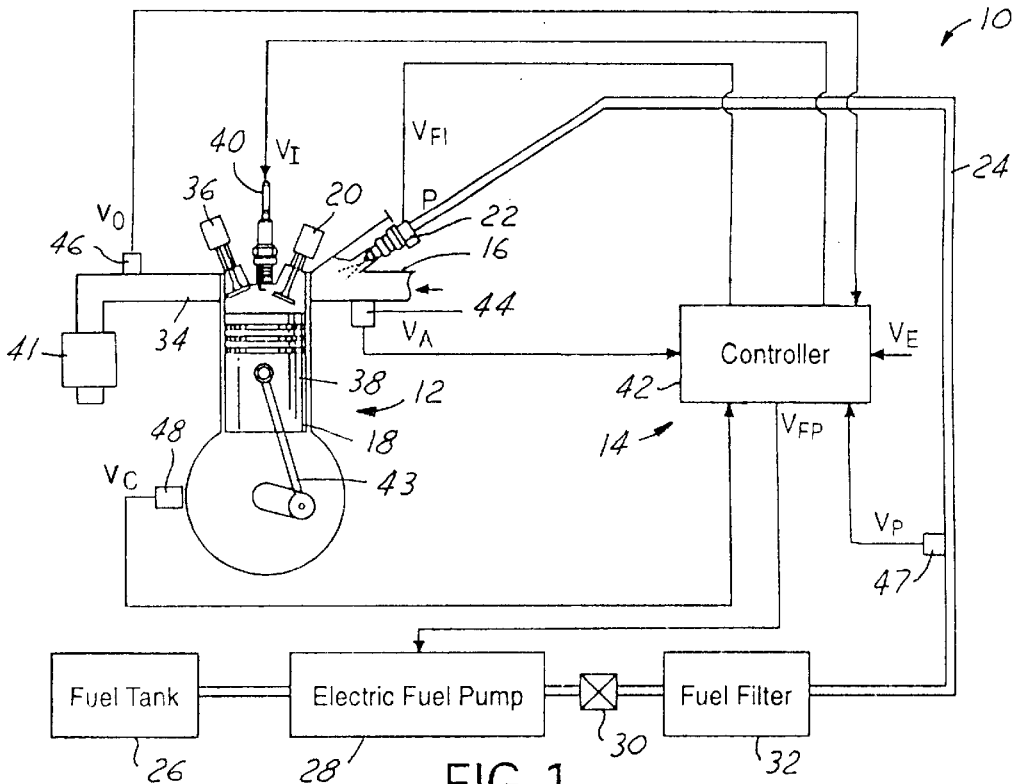
FIG. 1 is a combination schematic and block diagram of an automotive vehicle having an engine and a control system for implementing a method in accordance with the present invention.

Referring now to the drawings wherein like reference numerals are used to identify identical components in the various views, FIG. 1 illustrates an automotive vehicle generally indicated by numeral 10. The vehicle 10 includes an internal combustion engine 12 and a control system 14.

The engine 12 comprises an internal combustion engine. The engine 12 includes an intake manifold 16, cylinders 18, intake valves 20, fuel injectors 22, a fuel rail 24, a fuel tank 26, a fuel pump 28, a check valve 30, a fuel filter 32, an exhaust manifold 34, exhaust valves 36, pistons 38, spark plugs 40 and a catalytic converter 41. Engine 12 includes a plurality of cylinders 18, each cylinder 18 may have a corresponding fuel injector 22, intake valve 20, exhaust valve 36, and spark plug 40, even though one cylinder 18 is shown in FIG. 1 for purposes of clarity. It is also recognized that the invention claimed herein is also applicable to other fuel delivery systems such as a central fuel injected (CFI) system for each cylinder bank of an engine.

The intake manifold 16 directs air flow to the cylinders 18 of the engine 12. In particular, the manifold 16 directs air to an intake valve 20 which selectively controls the amount of air entering the respective cylinder 18. The configuration of the manifold 16 may vary based upon the number of cylinders 18 of the engine 12.

The fuel injectors 22 selectively provide fuel to one or more cylinders 18 and are conventional in the art. In particular, each fuel injector 18 delivers a predetermined amount of fuel into one or more cylinders 18 responsive to a fuel injector control signal $V_{FI}$ generated by the controller 42. Further, each fuel injector 28 receives a distinct fuel injector control signal $V_{FI}$ from the controller 42. The controller 42 varies the duty cycle of each fuel injector control signal $V_{FI}$ during an engine shutdown time interval as will be described in further detail below.

The components of engine 12 providing fuel to the fuel injectors 22 will now be discussed. The fuel pump 28 delivers fuel from the fuel tank 26 through the check valve 30 and the fuel filter 32 into the fuel rail 24. The fuel rail 24 supplies the pressurized fuel to the fuel injectors 22. The fuel pump 28 may comprise an electric fuel pump or the like and is turned on or off responsive to a fuel pump control signal $V_{FP}$ generated by the controller 42. The check valve 30 is provided to maintain fuel pressure in the fuel rail 24 when the fuel pump 28 is shut off. In particular, the check valve 30 closes when the fuel pump 28 is turned off which maintains the fuel in the fuel rail 24 at a relatively high pressure. Generally, the fuel in the fuel rail 24 is maintained at the high pressure so that sufficient fuel is available at the fuel injectors 22 when starting the engine 12. However, as previously discussed, undesirable evaporative emissions result from leaving the fuel at the high pressure after engine shutdown.

In an alternate embodiment, the check valve 30 may be removed from the engine 12. Thus, when fuel pump 28 turns off during engine shutdown, the residual fuel pressure in the fuel rail 24 would decrease as desired. However, this alternate embodiment would not allow the control system 14 to selectively control the fuel pressure during engine shutdown as desired. Further, the alternate embodiment would not allow the control system 14 to maintain the residual fuel pressure after engine shutdown in instances where a relatively high fuel pressure would be desired.

The exhaust manifold 34 directs exhaust gases from the cylinders 18 to the catalytic converter 41. In particular, the exhaust manifold 34 communicates with exhaust valves 36 which selectively control the amount of exhaust gases entering the exhaust manifold 34. The configuration of the manifold 34 may vary based upon the number of cylinders 18 of the engine 12.

The spark plugs 40 are provided to ignite the fuel in the cylinders 18 to drive the pistons 38. Each spark plug 40 ignites fuel in a cylinder 18 responsive to an ignition control signal $V_I$ generated by the controller 42. The controller 42 may generate each ignition control signal $V_I$ responsive to a position of the crankshaft 43 as known by those skilled in the art.

The catalytic converter 41 is provided to reduce undesirable byproducts of combustion in the engine 12. The catalytic converter 41 communicates with the exhaust manifold 34 and is conventional in the art.

The control system 14 is provided to control the engine 12 during an engine shutdown time interval to reduce evaporative emissions in accordance with the present invention. The control system 14 comprises a mass air flow sensor 44, an oxygen sensor 46, a fuel pressure sensor 47, a crankshaft position sensor 48, and a controller 42.

The mass air flow sensor 44 generates a signal $V_A$ indicative of the mass air flow in the intake manifold 16. The controller 42 receives the signal $V_A$ and derives the measured value of mass air flow MAF from the signal $V_A$. The sensor 44 is conventional in the art and is disposed in the intake manifold 16.

The oxygen sensor 46 generates a oxygen level signal $V_O$ proportional to the concentration of oxygen in the exhaust gases in the exhaust manifold 34. As previously discussed, the oxygen sensor 46 may comprise a Heated Exhaust Gas Oxygen (HEGO) sensor. The oxygen sensor 46 may comprise a hollow zirconium oxide ($Z_rO_2$) shell, the inside of which is exposed to atmosphere. The controller 42 receives the oxygen level signal $V_O$ and calculates a measured oxygen level responsive to the oxygen level signal $V_O$. The measured oxygen level is compared to a predetermined oxygen value which, for the particular oxygen sensor 46 used, represents the sensor voltage output at stoichiometry. This comparison produces a two-state condition flag indicating either a rich condition or a lean condition. A rich condition occurs when the measured oxygen level is less than the predetermined oxygen level (i.e., air/fuel ratio<stoichiometry). A lean condition occurs when the measured oxygen level is greater than the predetermined oxygen level (i.e., air/fuel ratio>stoichiometry).

The fuel pressure sensor 47 generates a fuel pressure signal $V_P$ indicative of the fuel pressure in the fuel rail 24. The pressure sensor 47 is conventional in the art. The controller 42 receives the fuel pressure signal $V_P$ and derives the measured fuel rail pressure P responsive to the fuel pressure signal $V_P$. In an alternate embodiment (not shown), the fuel pressure sensor 47 may be removed from the control system 14. In this alternate embodiment, the fuel pressure P may be calculated responsive to the rate of fuel flow through the fuel rail 24 as known by those skilled in the art.

The crankshaft position sensor 48 generates a crankshaft position signal $V_C$ indicative of the rotational position of the crankshaft 43. The crankshaft position sensor 48 is conventional in the art and may comprise a hall effect sensor. The controller 42 receives the crankshaft position signal $V_C$ and generates the ignition control signals $V_I$ responsive thereto, as known by those skilled in the art. The controller 42 may further calculate the engine speed S responsive to the crankshaft position signal $V_C$.

The controller 42 is provided to control the engine 12 in accordance with the present invention. The controller 42 is conventional in the art and is electrically connected to the fuel injectors 22, the fuel pump 28, the mass air flow sensor 44, the oxygen sensor 46, the spark plugs 40, and the crankshaft position sensor 48. During engine operation, the controller 42 receives oxygen level signal $V_O$ and controls the commanded air/fuel ratio AF and thus the commanded fueling level W responsive to the signal $V_O$. For example, an oxygen level signal $V_O$ indicating a rich air/fuel ratio will result in an increase in the commanded air/fuel ratio AF and a corresponding decrease in the commanded fueling level W to the engine 12. Alternately, an oxygen level signal $V_O$ indicating a lean air/fuel ratio will result in a decrease in the commanded air/fuel ratio AF and a corresponding increase in commanded fueling level W to the engine 12. The controller 42 includes a read-only memory (ROM) (not shown) that stores a software program for implementing the method in accordance with the present invention. The controller 42 also includes drivers (not shown) to transmit the respective control signals to the fuel injectors 22, the fuel pump 28, and the spark plugs 40.

Known Engine Control Method

FIGS. 2A–2G illustrate signals and parameters generated while implementing a known engine control method before and after engine shutdown. As will be shown, the control method results in a relatively high residual fuel pressure in the fuel rail 24 after engine shutdown. The high residual fuel pressure results in undesirable evaporative emissions from the fuel injectors 22. The engine 12 and the control system 14 may be utilized with the known engine control method and the inventive engine control method discussed in more detail below.

Figure 2A:
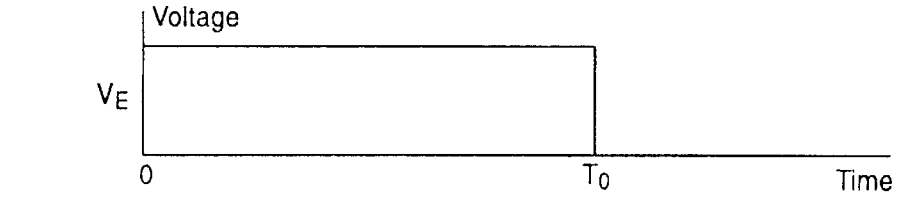
FIGS. 2A–G are diagrams illustrating engine control signals and parameters in accordance with a known method of shutting down an engine.
Figure 2B:
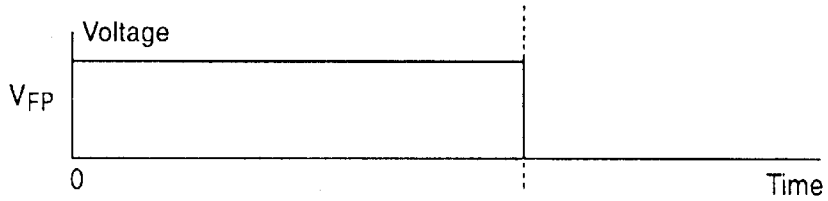
Figure 2C:
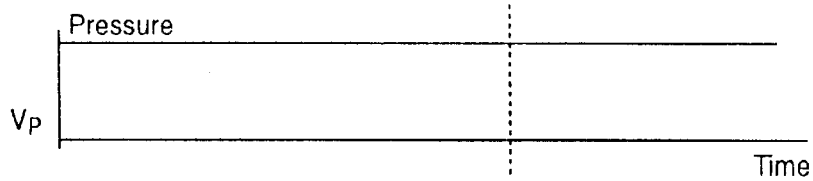

Referring to FIGS. 2A and 2B, during time interval T=0 to $T=T_0$, the controller 42 receives an engine control signal $V_E$ with a high logic level—indicating that engine 12 should have closed-loop controlled operation. In particular, the engine control signal $V_E$ may be transmitted to the controller 42 from an ignition switch (not shown). For example, if an operator closes an ignition switch to start the engine 12, the engine control signal $V_E$ may transition from a low logic level to a high logic level. Conversely, if an operator opens an ignition switch to shut off the engine 12, the engine control signal $V_E$ may transition from a high logic level to a low logic level. Referring to FIG. 2B, in response to the signal $V_E$, the controller 42 generates a fuel pump control signal $V_{FP}$ with a high logic level. In response to the signal $V_{FP}$, the fuel pump 28 delivers fuel through the fuel rail 24 to the fuel injectors 22. Thus, the measured fuel rail pressure P (represented by $V_P$) is maintained at a relatively constant pressure as illustrated in FIG. 2C.

Figure 2D:
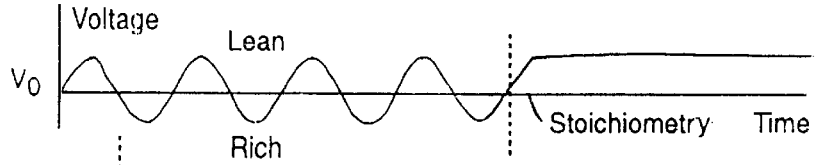
Figure 2E:
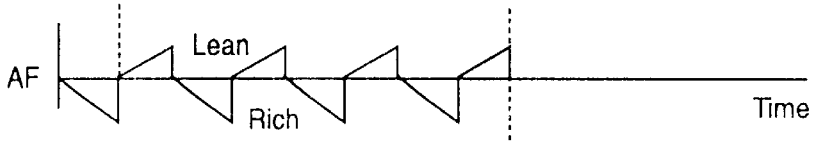

Referring to FIGS. 2D and 2E, during time interval T=0 to $T=T_0$, the oxygen level signal $V_O$ oscillates about a stoichiometric level as known by those skilled in the art. Further, the commanded air/fuel ratio AF oscillates about a corresponding stoichiometric level responsive to the oxygen level signal $V_O$. In particular, when the oxygen level signal $V_O$ indicates the measured air/fuel ratio is stoichiometric, the commanded air/fuel ratio AF "jumps back" to a predetermined nominal air/fuel mixture which is hoped to be at or near stoichiometry. Thereafter, the commanded air/fuel ratio AF is gradually altered in a direction opposite to its prior direction of change until the oxygen sensor 46 determines that stoichiometry has again been reached.

Figure 2F:
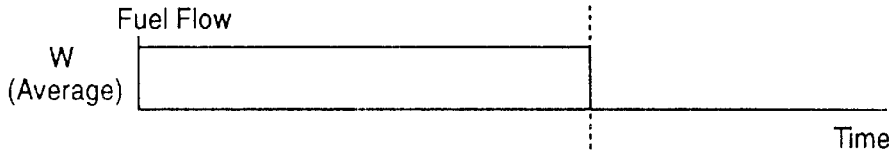
Figure 2G:
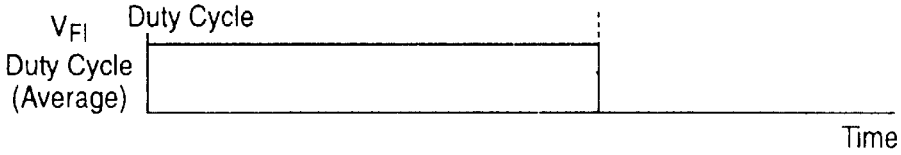

Referring to FIGS. 2F and 2G, during time interval T=0 to $T=T_0$, the average commanded fueling level W is at a relatively constant value responsive to the commanded air/fuel ratio AF. Further, the average duty cycle of the fuel injectors 22 is at a relatively constant value responsive to the commanded fueling level W.

Referring to FIG. 2A, at time $T=T_0$, the engine control signal $V_E$ transitions to a low logic level indicating that the engine 12 should be shut down. In response to the signal $V_E$, the controller 42 immediately transitions the fuel pump control signal $V_{FP}$ to a low logic level to shut off the fuel pump 28.

Referring to FIGS. 2D and 2E, after time $T=T_0$, the oxygen level signal $V_O$ remains at a constant value and the oscillation of the commanded air/fuel ratio AF is stopped. Referring to FIGS. 2F and 2G, the average commanded fueling level W falls to a zero value and correspondingly the duty cycle of the fuel injector control signal $V_{FI}$ falls to a zero value. As illustrated in FIG. 2C, the fuel pressure P (represented by pressure signal $V_P$) in the fuel rail 24 remains at a relatively high pressure level because the check valve 30 closed when the fuel pump 28 turned off. Although not shown in FIG. 2C, the fuel rail pressure P may eventually decrease over time if the residual fuel in the fuel rail 24 migrates past the fuel injectors 22 into the intake manifold 16. Thus, the known engine control method may result in undesirable evaporative emissions from the fuel injectors 22.

Inventive Engine Control Method

The controller 42 operates in accordance with a software program stored in the ROM (not shown) which implements the method of controlling an internal combustion engine in accordance with the present invention. FIGS. 4A–4D form a flowchart of the inventive method that is implemented by the software program. FIGS. 3A–3G illustrate signals and parameters generated while implementing the inventive method.

Figure 4A:
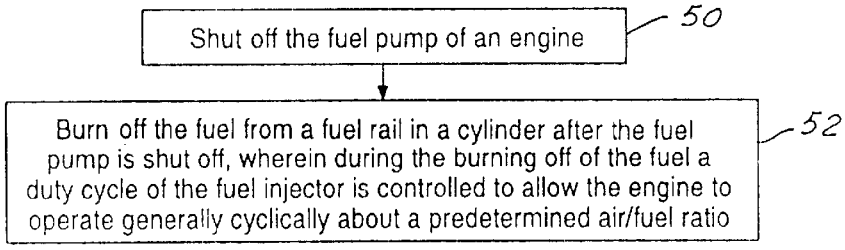
FIGS. 4A–D are flow charts illustrating a method for controlling an engine during an engine shutdown time interval in accordance with the present invention.
Figure 3A:
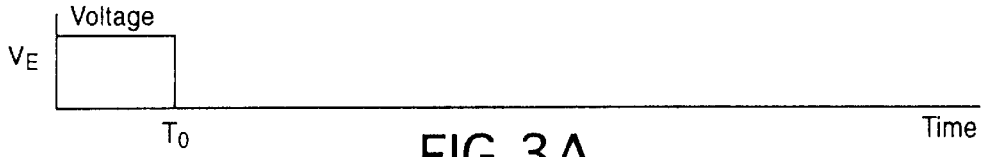
FIGS. 3A–G are diagrams illustrating engine control signals and parameters in accordance with a method of shutting down an engine in accordance with the present invention.
Figure 3B:
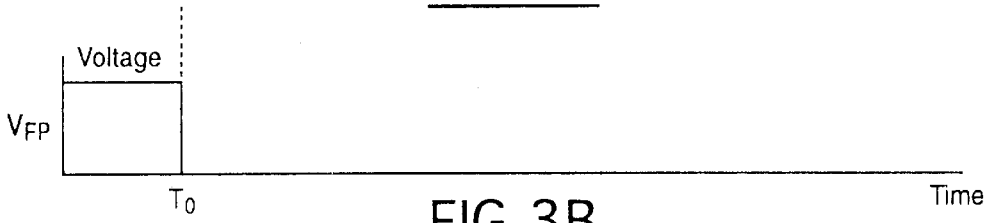

Referring to FIG. 4A, a method of controlling an internal combustion engine 12 includes a step 50 of shutting off the fuel pump 28 of the engine 12. Referring to FIGS. 3A and 3B, at time $T_0$, the engine control signal $V_E$, transitions to low logic level indicating that the engine 12 should be shut down. As previously discussed, the engine control signal $V_E$ may be controlled by an ignition switch (not shown). Alternately, the engine control signal $V_E$ may be a control value calculated responsive to the state of an ignition switch (not shown) of the engine 12. The method further includes a step 52 that burns off fuel from the fuel rail 24 in one ore more cylinders 18 after the fuel pump 28 is shut off. During the burning of the fuel, a duty cycle of the fuel injectors 22 is controlled to allow the engine 12 to operate generally cyclically about a predetermined air/fuel ratio. The predetermined air/fuel ratio is preferably stoichiometric.

Figure 4B:
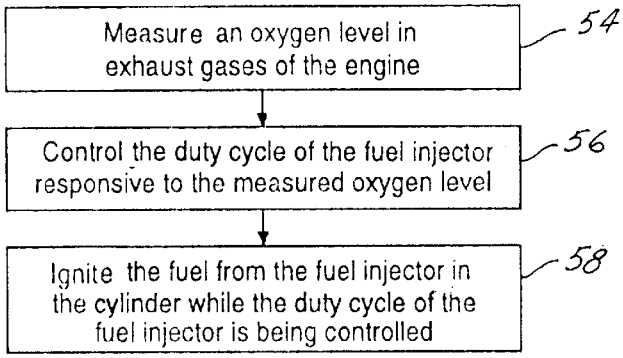

Referring to FIG. 4B, the step 52 may include the substeps 54, 56, and 58. The substep 54 measures the oxygen level in the exhaust gases of the engine 12. As previously discussed, the oxygen sensor 46 generates an oxygen level signal $V_O$ used to calculate the measured oxygen level in the exhaust gases. Further, as previously discussed, the measured oxygen level is used to set a condition flag that indicates a the engine 12 is operating in a lean condition or a rich condition. The substep 56 controls the duty cycle of the fuel injectors 22 responsive to the oxygen level.

Figure 4C:
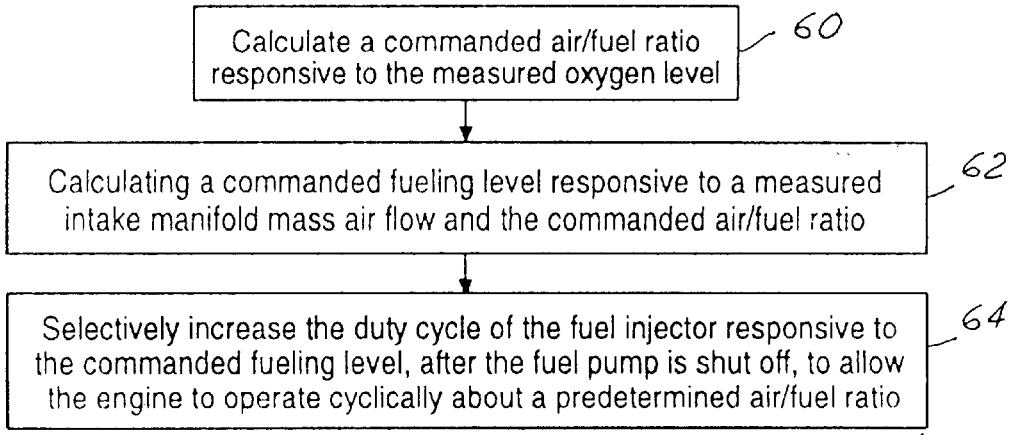
Figure 4D:
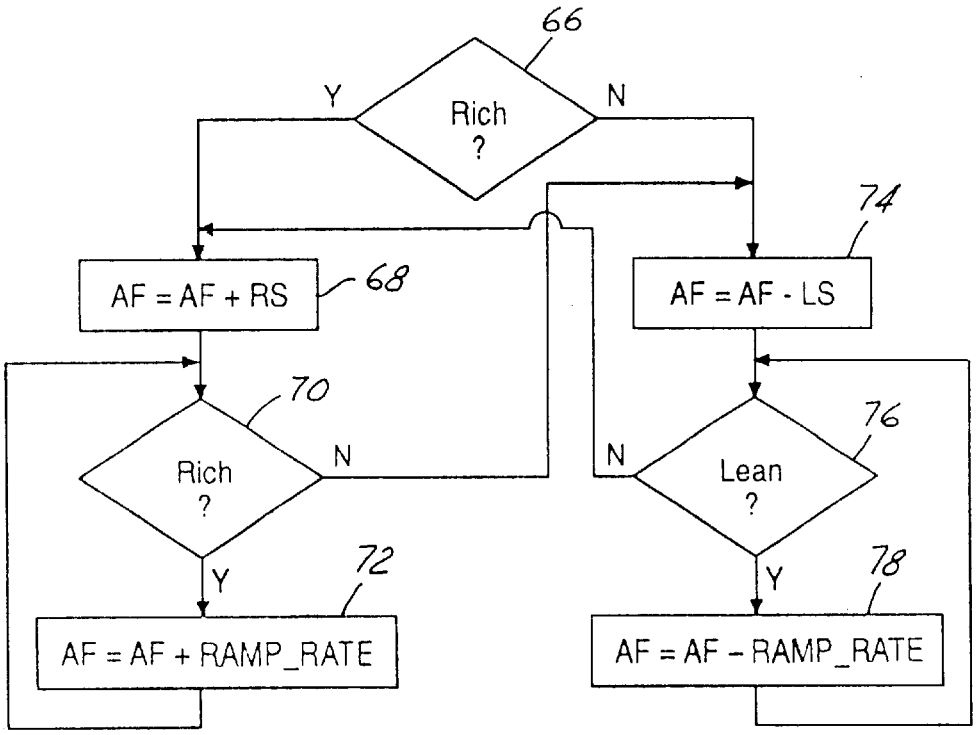

Referring to FIG. 4C, the substep 56 may include the substeps 60, 62, and 64. The substep 60 calculates a commanded air/fuel ratio AF responsive to the measured oxygen level. Referring to FIG. 4D, the substep 60 may include interactively executing the background processing substeps 66–78. Before explaining the substeps 66–78, the variables utilized by the controller 42 in performing these substeps will be explained. The variables include:

- commanded air/fuel ratio AF=AIR/FUEL_BASE when the controller 42 is initially powered up;
- AIR/FUEL_BASE=about 14.6 for conventional internal combustion engines using gasoline;
- RS=a rich offset value to increase commanded air/fuel ratio AF when a rich fueling condition exists;
- LS=a lean offset value to decrease commanded air/fuel ratio AF when a lean fueling condition exists;
- RAMP_RATE=ramp rate to modify commanded air/fuel ratio AF when a rich or lean fueling condition exists.

Figure 3C:
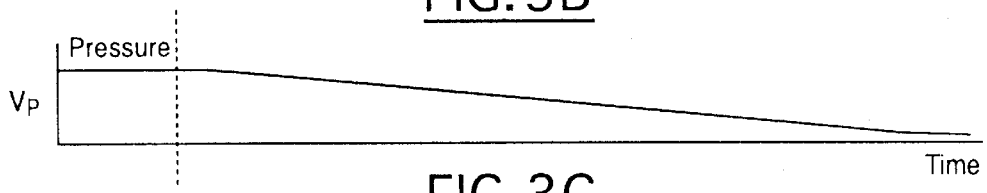
Figure 3D:
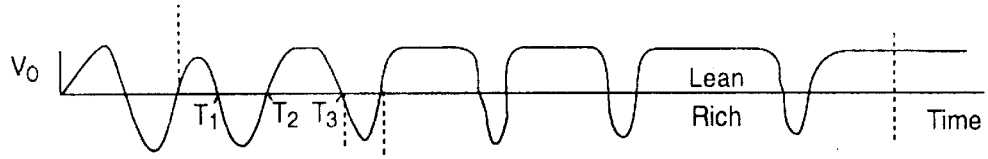
Figure 3E:
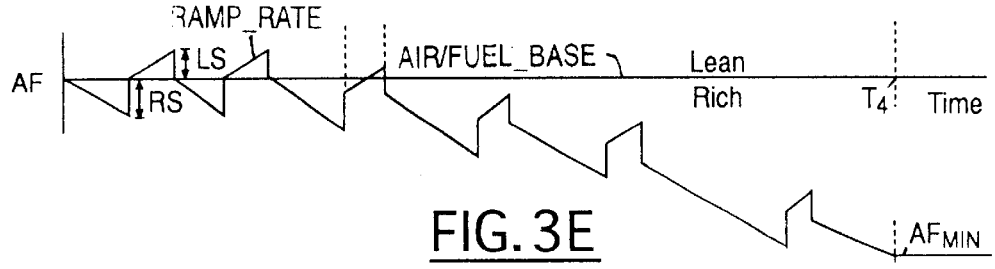

While performing the substeps 66–78, the commanded air/fuel ratio AF is increased or decreased using RS, LS, and the RAMP_RATE to try to maintain stoichiometric engine operation. Referring to FIG. 4D, the substeps 66–78 will now be explained. The substep 66 determines whether the measured oxygen level indicates a rich condition. If a rich condition exists, the substep 68 increases the commanded air/fuel ratio AF (AF=AF+RS). As shown in FIGS. 3D and 3E, the oxygen level signal $V_O$ indicates a transition to a rich condition at time $T_1$ which results in the commanded air/fuel ratio AF being increased by RS. Thereafter, the method enters a loop including the substeps 70 and 72. The substep 70 determines whether the measured oxygen level still indicates a rich condition. If a rich condition still exists, the substep 72 further increases the commanded air/fuel ratio AF (AF=AF+RAMP_RATE). As shown in FIGS. 3D and 3E, the oxygen level signal $V_O$ after time $T_1$ (and before time $T_2$) still indicates a rich condition which results in the commanded air/fuel ratio AF being increased by RAMP_RATE.

Referring again to FIG. 4D, if the substep 70 or the substep 66 indicates a lean condition, the method advances to the substep 74. The substep 74 modifies the commanded air/fuel ratio AF (AF=AF−LS) to decrease the commanded air/fuel ratio AF. As shown in FIGS. 3D and 3E, the oxygen level signal $V_O$ indicates a transition to a lean condition at time $T=T_2$ which results in the commanded air/fuel ratio AF being decreased by LS. Thereafter, the method enters a loop including the substeps 76 and 78. The substep 76 determines whether the measured oxygen level still indicates a lean condition. If a lean condition still exists, the substep 78 decreases the commanded air/fuel ratio AF (AF=AF−RAMP_RATE) to further decrease the commanded air/fuel ratio AF. As shown in FIGS. 3D and 3E, the oxygen level signal $V_O$ after time $T_2$ (and before time $T_3$) still indicates a lean condition which results in the commanded air/fuel ratio AF being decreased by the RAMP_RATE. Finally, if the substep 76 indicates a rich condition, the method advances to the substep 68.

As shown in FIGS. 3D and 3E, the method iteratively adjusts the commanded air/fuel ratio AF to try to maintain the engine at stoichiometry, after the fuel pump 28 has been shut off at time $T=T_0$. In particular, the commanded air/fuel ratio AF is progressively decreased to maintain the engine at stoichiometry while the fuel in the fuel rail 24 is being consumed.

Referring again to FIG. 4C, each time the background processing substeps 66–78 modify the commanded air/fuel ratio AF, the method advances to the substep 62. The substep 62 calculates a commanded fueling level W responsive to the measured intake manifold air flow MAF and the commanded air/fuel ratio AF. The fueling level W may be calculated using the following formula:

W=MAF/AF.

Figure 3F:
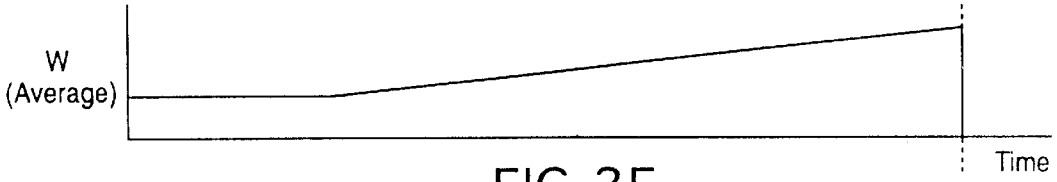
Figure 3G:
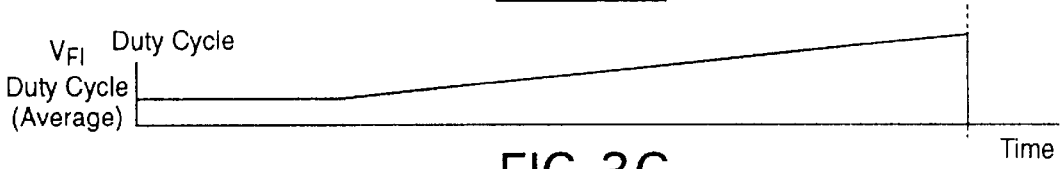

The method advances to the substep 64 after the substep 62. The substep 64 selectively increases the duty cycle of the fuel injectors 22 responsive to the commanded fueling level W to allow the engine 12 to operate cyclically about a predetermined air/fuel ratio. As previously discussed, the predetermined air/fuel ratio is preferably stoichiometric. Referring to FIGS. 3C, 3F, and 3G, after the fuel pump 28 is turned off at time $T=T_0$, the fuel pressure P in fuel rail 24 begins to decrease, and thus the command fueling level W must be steadily increased to maintain the engine 12 at stoichiometric operation. Thus, the duty cycle of the fuel injectors 22 must also be increased as the fuel pressure P in decreases to keep delivering the required amounts of fuel to the cylinders 18. The duty cycle of each of the fuel injectors 22 may be determined using the following two equations:

PW=((C/AF)*(1/INJS))+OFFSET; where

PW=commanded pulse width of the fuel injector control signal $V_{FI}$ (seconds);

C=amount of air inducted into a cylinder 18 (lbs.)

AF=commanded air/fuel ratio;

INJS=fuel injector slope (lbs. per second);

OFFSET=pulse width offset due to variable battery voltage (seconds); and,

D=S*PW*CF; where

D=duty cycle of the fuel injector control signal $V_{FI}$;

S=engine speed (revolutions/second)

CF=conversion factor empirically determined responsive to the clock speed of the controller 42.

As illustrated in FIGS. 3C, 3F, and 3G, after time $T=T_0$, the average commanded fueling level W and the average duty cycle of the fuel injector control signal $V_{FI}$ is inversely proportional to the fuel rail pressure P (represented by $V_P$).

Referring to FIG. 4B, the method finally advances to the substep 58 after the substep 56. The substep 58 sequentially ignites fuel from the fuel injectors 22 in the cylinders 18 while the duty cycle of the fuel injectors 22 are being controlled. The substep 58 iteratively ignites the cylinders 18 while the substeps 54 and 56 are also being iteratively performed. In particular, the controller 42 generates an ignition control signal $V_I$ for each spark plug 40 responsive to the position of the crankshaft 43 as known by those skilled in the art.

The duration that the controller 42 performs the step 52 will now be explained in greater detail. Referring to FIGS. 3E, 3F, 3G, the controller 42 controls engine 12 after the fuel pump 28 has been shut off for an engine shutdown timing interval. The engine shutdown timing interval starts at time $T=T_0$ when the fuel pump 28 is shut off and ends at time $T=T_4$. During the engine shutdown timing interval, the fuel injectors 22 supply fuel to the cylinders 18 which is burned therein. Thus, during this timing interval, the measured fuel rail pressure P is decreased as the remaining fuel in the fuel rail 24 is consumed. The end time $T=T_4$ occurs when an engine operational parameter becomes (i) greater than a threshold value or (ii) less than the threshold value.

The engine operational parameter may comprise (i) the measured fuel pressure P, (ii) the measured oxygen level, (iii) the commanded air/fuel ratio AF, or (iv) the average duty cycle of one or more fuel injectors 22. In particular, time $T=T_4$ occurs when one of the following conditions is met:

(i) measured fuel pressure P<a threshold pressure level;

(ii) measured oxygen level>a threshold oxygen level;

(iii) commanded air/fuel ratio AF<a threshold air/fuel ratio; or (iv) average duty cycle of the fuel injectors 22>a threshold duty cycle.

The threshold values including (i) the threshold pressure level, (ii) the threshold oxygen level, (iii) the threshold air/fuel ratio; and (iv) the threshold duty cycle, may be empirically determined by one skilled in the art. In particular, the threshold values indicate when the engine 12 is no longer capable of being operated stoichiometric due to insufficient amounts of available fuel in the fuel rail 24. For example, referring to FIG. 3E, the predetermined threshold parameter $AF_{MIN}$ represents a commanded air/fuel value under which the engine 12 cannot be operated stoichiometric.

When the commanded air/fuel value AF is less than $AF_{MIN}$, the controller 42 stops any further control of the fuel injectors 22 as shown by the average $V_{FI}$ duty cycle being a zero value. Further, the controller 42 simultaneously stops any further control of the spark plugs 40 to ignite the fuel in the cylinders 18.

The method of controlling an engine during engine shutdown to reduce evaporative emissions represents a significant improvement over conventional methods. As shown in FIG. 3C, the inventive method reduces the fuel pressure in the fuel rail 24 during an engine shutdown timing interval (i.e., time $T_0$–$T_4$) by burning the residual fuel in the fuel rail 24 after the fuel pump 28 has been shut off. As a result, the reduced pressure in the fuel rail 24 reduces the evaporative emissions from the engine 12.

While the invention has been particularly shown and described with reference to a preferred embodiment thereof, it is well understood by those skilled in the art that various changes and modifications can be made in the invention without departing from the spirit and the scope of the invention.

We claim:

1. A method for controlling an internal combustion engine during engine shutdown to reduce evaporative emissions, said engine having a fuel pump supplying fuel through a fuel rail to a fuel injector, said fuel injector communicating with an engine cylinder, said method comprising:

shutting off said fuel pump of said engine; and, burning off said fuel from said fuel rail in said cylinder after said fuel pump is shut off, wherein during said burning off of said fuel a duty cycle of said fuel injector is controlled to allow said engine to operate generally cyclically about a predetermined air/fuel ratio.

2. The method of claim 1 wherein said predetermined air/fuel ratio is stoichiometric.

3. The method of claim 1 wherein said burning off of said fuel includes:

measuring an oxygen level in exhaust gases of said engine;

controlling said duty cycle of said fuel injector responsive to said oxygen level; and, igniting said fuel from said fuel injector in said cylinder while said duty cycle of said fuel injector is being controlled.

4. The method of claim 3 wherein said oxygen level is measured in an exhaust manifold of said engine.

5. The method of claim 3 wherein said controlling said duty cycle of said fuel injector includes:

calculating a commanded air/fuel ratio responsive to said oxygen level;

calculating a commanded fueling level responsive to a measured intake manifold mass air flow and said commanded air/fuel ratio; and, selectively increasing said duty cycle of said fuel injector responsive to said commanded fueling level, after said fuel pump is shut off, to allow said engine to operate cyclically about said predetermined air/fuel ratio.

6. The method of claim 1 wherein when said oxygen level indicates a lean operating condition said duty cycle of said fuel injector is increased.

7. The method of claim 1 wherein said burning off of said fuel is stopped responsive to an engine operational parameter and a threshold value.

8. The method of claim 7 wherein said engine operational parameter is said measured oxygen level in said exhaust gases of said engine and said threshold value is a threshold oxygen level, wherein said burning off of said fuel is stopped when said oxygen level is greater than said threshold oxygen level.

9. The method of claim 7 wherein said engine operational parameter is a measured or calculated fuel rail pressure in said engine and said threshold value is a threshold pressure level, wherein said burning off of said fuel is stopped when said measured or calculated fuel rail pressure is less than said threshold pressure.

10. The method of claim 7 wherein said engine operational parameter is a measured oxygen level in exhaust gases of said engine and said threshold value is a threshold oxygen level, wherein said burning off of said fuel is stopped when said measured oxygen level is greater than said threshold oxygen level.

11. The method of claim 7 wherein said engine operational parameter is a commanded air/fuel ratio of said engine and said threshold value is a threshold air/fuel ratio, wherein said burning off of said fuel is stopped when said commanded air/fuel ratio less than said threshold air/fuel ratio.

12. The method of claim 7 wherein said engine operational parameter is said duty cycle of said fuel injector and said threshold value is a threshold duty cycle, wherein said burning off of said fuel is stopped when said duty cycle of said fuel injector is greater than said threshold duty cycle.

13. A method for depressurizing a fuel rail in an internal combustion engine during engine shutdown to reduce evaporative emissions, said engine having a fuel pump supplying fuel through said fuel rail to a fuel injector, said fuel injector communicating with an engine cylinder, said method comprising:

shutting off said fuel pump;

measuring an oxygen level in exhaust gases of said engine;

controlling said duty cycle of said fuel injector responsive to said oxygen level after said fuel pump has been shut off; and, igniting said fuel from said fuel injector in said cylinder while said duty cycle of said fuel injector is being controlled.

14. The method of claim 13 wherein said oxygen level is measured in an exhaust manifold of said engine.

15. The method of claim 13 wherein when said oxygen level indicates a lean operating condition for increasing periods of time said duty cycle of said fuel injector is increased.

16. The method of claim 13 controlling said duty cycle of said fuel injector includes:

calculating a commanded air/fuel ratio responsive to said oxygen level;

calculating a commanded fueling level responsive to a measured intake manifold mass air flow and said commanded air/fuel ratio; and, selectively increasing said duty cycle of said fuel injector responsive to said commanded fueling level to allow said engine to operate cyclically about a predetermined air/fuel ratio.

17. The method of claim 16 wherein said predetermined air/fuel ratio is stoichiometric.

18. A method for controlling an internal combustion engine during engine shutdown to reduce evaporative emissions, said engine having a fuel pump supplying fuel through a fuel rail to a fuel injector, said fuel injector communicating with an engine cylinder, said method comprising:

shutting off said fuel pump of said engine; and, supplying fuel from said fuel rail to said cylinder after said fuel pump is shut off.

19. The method of claim 18 further comprising the step of:

igniting said fuel in said cylinder after said fuel pump is shut off.

20. An automotive vehicle, comprising:

an engine having a fuel injector selectively supplying fuel to a cylinder of said engine, said engine further including a fuel pump selectively supplying fuel through a fuel line to said fuel injector; and, a controller operatively connected to said fuel injector and said fuel pump, said controller being configured to shut off said fuel pump upon a change of state of an engine control signal, said controller being further configured to control a duty cycle of said fuel injector, after said fuel pump is shut off, to allow said engine to operate cyclically about a predetermined air/fuel level.

21. The automotive vehicle of claim 20 wherein said predetermined air/fuel ratio is stoichiometric.

22. The automotive vehicle of claim 20 further comprising an oxygen sensor operatively connected to said controller, said oxygen sensor generating a oxygen level signal indicative of a level of oxygen in exhaust gases of said engine, said controller varying said duty cycle of said fuel injector control signal responsive to said oxygen level signal.

23. The automotive vehicle of claim 22 wherein said oxygen sensor is a heated exhaust gas oxygen sensor.

24. The automotive vehicle of claim 20 wherein when said oxygen level indicates a lean operating condition for increasing periods of time, said controller increases said duty cycle of said fuel injector control signal.

25. The automotive vehicle of claim 20 wherein said controller is further configured to shut off said fuel injector responsive to an engine operational parameter and a threshold value.

26. A controller for an engine, said engine having an intake manifold with a mass air flow sensor generating a mass air flow signal responsive to an amount of air flow in said intake manifold, an exhaust manifold with an oxygen sensor generating an oxygen level signal responsive to an amount of oxygen in exhaust gases in said exhaust manifold, and a fuel pump supplying fuel to a fuel injector, said controller being configured to turn off said fuel pump upon a change of state of an engine control signal, said controller being further configured to calculate a commanded air/fuel ratio responsive to said oxygen level signal, said controller being further configured to calculate a commanded fueling level responsive to said mass air flow signal and said commanded air/fuel ratio, said controller being further configured to control a duty cycle of said fuel injector, after said fuel pump is shut off, to allow said engine to operate cyclically about a predetermined air/fuel ratio.

27. The controller of claim 26 wherein when said oxygen level indicates a lean operating condition for increasing periods of time, said controller increases said duty cycle of said fuel injector.

* * * * *